US006354593B1

(12) United States Patent
Frommer et al.

(10) Patent No.: US 6,354,593 B1
(45) Date of Patent: Mar. 12, 2002

(54) MULTI-LEVEL MATCHING GAME AND METHOD

(76) Inventors: Dror Frommer, 42 Glendale Ave.; Michael Bernstein, 10 Wildwood Ave., both of Livingston, NJ (US) 07039

( * ) Notice: Subject to any disclaimer, the term of this patent is extended or adjusted under 35 U.S.C. 154(b) by 0 days.

(21) Appl. No.: 09/437,842

(22) Filed: Nov. 10, 1999

(51) Int. Cl.[7] ..... A63F 3/06; B42D 15/00
(52) U.S. Cl. ..... 273/274; 273/139
(58) Field of Search ..... 273/274, 292, 273/269, 139; 283/901, 903

(56) References Cited

U.S. PATENT DOCUMENTS 4,362,303 A * 12/1982 Pell
4,861,041 A 8/1989 Jones
5,407,200 A * 4/1995 Zalabak
5,489,101 A * 2/1996 Moody
5,536,016 A 7/1996 Thompson
5,540,441 A * 7/1996 Ilan et al.
5,690,367 A 11/1997 Fromer
5,700,009 A 12/1997 Meoni
5,700,010 A 12/1997 Mimier
5,718,431 A * 2/1998 Ornstein
5,839,730 A 11/1998 Pike

* cited by examiner

*Primary Examiner*—William M. Pierce
(74) *Attorney, Agent, or Firm*—Andrew Auerbach Agent

(57) ABSTRACT

A method of playing a game of chance by selecting symbols, such as cards, for display on a pyramidal or a progressively narrowing geometric game board and arranging said selected card symbols in an array of at least three groups. The cards are selected so the statistical odds of a match in a first group of card symbols are of a highest amount and a match in a third group of card symbols are of a lowest amount. Cards are selected to determine in a corresponding sequence a match with card symbols. Only those individuals playing the game who have successfully matched the card symbols in the first group may play in the second group and only those individuals playing the game who have successfully matched the card symbols in the second group may play in the third group. A wager is placed for a round of match play and each subsequent round of wagering depends on prevailing in the previous round. Also provided is a bye option, which allows the player to advance from the initial round to subsequent rounds of play by matching the dealer's card. A means for increasing the payout in subsequent rounds is based on the matching of the same card symbols in several rounds.

13 Claims, 3 Drawing Sheets

MULTI-LEVEL MATCHING GAME AND METHOD

BACKGROUND OF THE INVENTION

1. Field of the Invention

The present invention relates to a card game and more particularly a multi-level one card matching game in which symbols for display on a game board, preferably in the form of conventional playing card symbols, are arranged in at least three groups. These card symbols for display may be imprinted on a game board surface be made of cloth, paper, etc. A dealer is used to deal a single card per round to each player, but does not participate in the play of the game except as will be specified later. Players must match the card symbols for display on a game board with the single card dealt to them to win. . A pyramidal or a progressively narrowing game board may be used to display these card symbols, so the statistical odds of a match in the first group of cards are of the highest amount and a match in a second group of card symbols are of a lower amount, and a match in the third group of card symbols are of a lowest amount. Therefore the best chance for winning is in first round play in the first tier of the pyramid. Electronic displays and card generating means may be used to achieve electronic automated play.

2. Description of the Prior Art

This instant invention, in one embodiment is a one card matching game, and is similar in intent to a game such as War or Beggar my Neighbor where the highest place value of the card or the matching of a specific card dealt determines the winner of any given round.

Comparing this game to a Lottery Card and Method (U.S. Pat. No. 5,690,367) invented by Shmuel Frommer, it can be seen that there are some common elements to this instant invention in that the play is multi-level. The chance of obtaining a winning combination decreases as play progresses, while the reward or payoff increases. Games of dice also have some common features with this invention. For example U.S. Pat. No. 5,700,010 to Mimier describes a dice game with a single die wherein a particular number must be rolled to collect the primary bet of 2:1. Bets are raised for the next round of betting.

Also a number matching card game is well known in the art. The applicant is aware of patented card games such as U.S. Pat. No. 5,700,009 invented by Meoni which rely on number matching for entitlement to a payoff. Similarly, U.S. Pat. No. 5,536,016 to Thompson is a match number game with a progressive jackpot. U.S. Pat. No. 4,861,041 to Jones describes a system for collecting a progressive jackpot. In the latter two disclosures it is the jackpot that is progressive and not the game. The present invention involves multi-level play with increasing odds, which is exclusive to winners of the previous round. The prior art patents do not disclose a game in which total winnings are at risk if the player continues the game. The prior art also does not disclose a game that allows the player to have an element of choice to play in successive groups in a multi-level game. This provides for the compounding of winnings at progressively higher odds.

SUMMARY OF THE INVENTION

In view of the foregoing features inherent in the known types of card games now present in the prior art, the present invention provides a new type of matching card game, which is multi-level and progressive in nature. The instant invention is a one card matching game in which symbols or more preferably card symbols for display on a game board are arranged in at least three groups. A game board surface may be made of cloth, paper, etc. with the card symbols displayed thereon. Each player's station on the table cloth will have an imprinted set of card symbols. This table cloth may be used as a gaming table. The imprinted card symbols may be conventionally associated with symbols from a conventional playing card deck face cards or with other types of card symbols that may be in common use or as specified by the game rules.

A dealer deals a single card per round to each player, but does not participate in the play of the game except as explained hereinafter. Players must match the card symbols for display on a game board with the single card dealt to them to win. A pyramidal or progressively narrowing geometric game board may be used to display these card symbols as in FIG. 1. This progressive narrowing is in parallel with the decreasing odds of finding a match, based on a smaller number of card symbols for display on a game board to match in the higher game levels. The card symbols for display on a game board are selected so as statistical odds of a match in the first group of card symbols are of the highest amount and a match in a second group of card symbols are of a lower amount, and a match in the third group of card symbols are of a lowest amount. Wagering is typically made prior to the first round. Matching of the dealer card in the first round will result in a bye provision to the player, which will allow the player to progress to the second round. Otherwise, only winners of the first round may play in the second round and only the winners of the second round may play in the third round. This provides the winning player of the first round with an opportunity to progress to the second round with a potentially larger payoff.

It is therefore an object of this invention to provide a new card game display and method for playing this game which has many of the advantages of the games previously mentioned and many additional novel features involving a one card match, pyramidal multi-level play, compounding payoffs, risk of all winnings for advancement to a succeeding round and player's choice as to whether to proceed to the next round.

It is a further object of this invention to allow for a bye provision whereby the matching of the dealt card to the player with the card displayed by the dealer would allow the player to progress to the next higher group without the necessity of matching the card symbols on display. This increases the odds of a player being able to progress to the next round and therefore increases the pool of prospective multi-level winners.

It is a further object of this invention to allow for the use of an odds multiplier. If the game is limited to three rounds and a specified card is dealt in all three rounds then the normal odds payoff would be multiplied by a set prearranged factor. A prepayment prior to the start of play, which would alter the odds payout if the player successfully matched in all three groups would be necessary. For example the prepayment in the beginning of the game that would reward the player with higher odds if he received three aces (one in each round).

Another object of the invention is to allow for the use of electronic displays (light emitting diode and liquid crystal) and random card generating means to provide for automation of the play of this game through the use of electronics.

BRIEF DESCRIPTION OF THE DRAWINGS

The invention will be more clearly understood in the light of the examples described below in conjunction with the attached drawings, wherein.

DESCRIPTION OF THE PREFERRED EMBODIMENT

Figure 1:
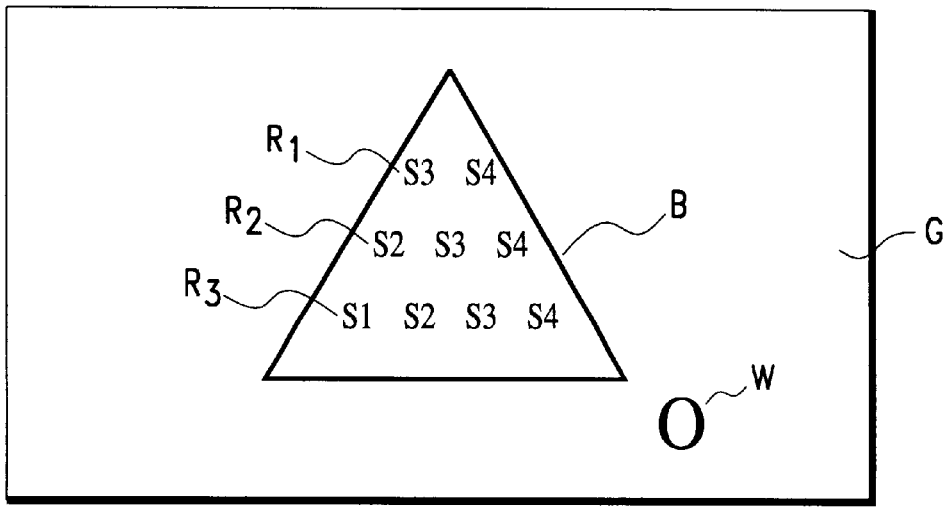
FIG. 1 represents a broad embodiment of the game with symbols encoded in symbol format.
Figure 2:
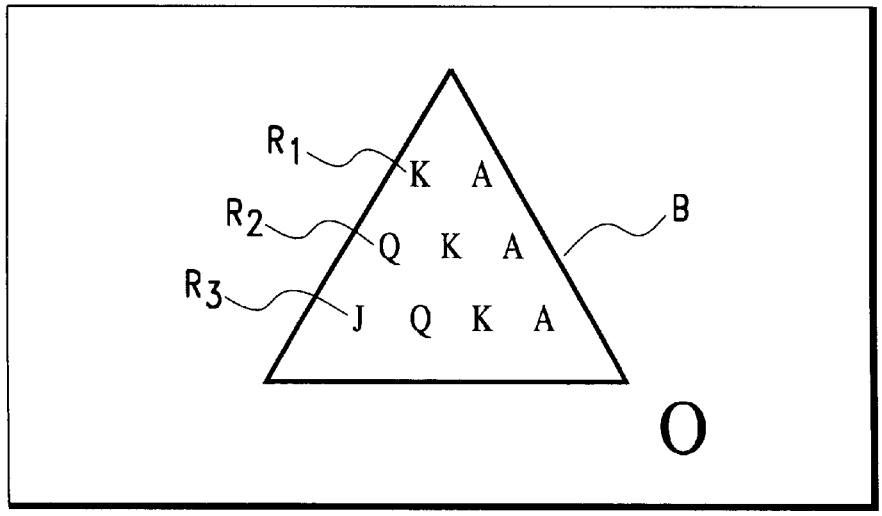
FIG. 2 illustrates a preferred embodiment of the game where the symbols are typical symbols used in playing cards such as Jack (J), Queen (Q), King (K) and Ace (A)
Figure 3:
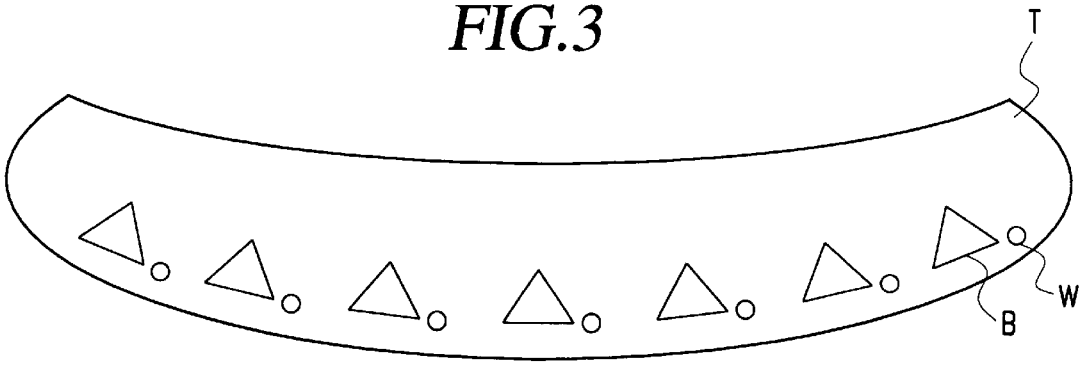
FIG. 3 illustrates the actual gaming table showing the pyramidal game board at each player station and FIG. 4 illustrates the use of electronic displays (light emitting diode or liquid crystal) and random card generating means to provide for automation of the play of this game through the use of electronics.

With reference now to the drawings, and in particular to FIGS. 1–2 thereof, a new card game will be described. More specifically referring to FIG. 1 there is shown a pyramidal game board B containing three tiers, R1, R2, and R3. Each tier contains symbols imprinted on the game board that may be designated as S1, S2, S3 and S4. In the FIG. 1, the first tier contains four symbols. The second tier contains three symbols, and the third tier contains two symbols. Note that the symbols were all taken from the same set of S1–S4. These are structured pyramidally so that it is progressively more difficult to get a match between the card symbols for display on a game board and the matching cards dealt to the players. The game board surface, G, can be made of cloth, plastic cardboard or other related types of materials. FIG. 2, shows a preferred embodiment with, the symbols for display on a game board are playing card symbols which have symbols designated as Jack (J), Queen (Q), King (K) and Ace (A). The matching cards may be obtained from a conventional regulation card deck that contains 52 cards. These cards are dealt to the players using a dealer. A dealer is used to dispense a single card per round to each player, but does not participate in the play of the game. However, the matching of the dealer's card in the first round will allow the player to progress to the second round based on the bye provision to be explained hereinafter. The arrangement of these game boards (B) around the gaming table (T) can be seen in FIG. 3. Each player will have a separate game board to play.

Figure 5:
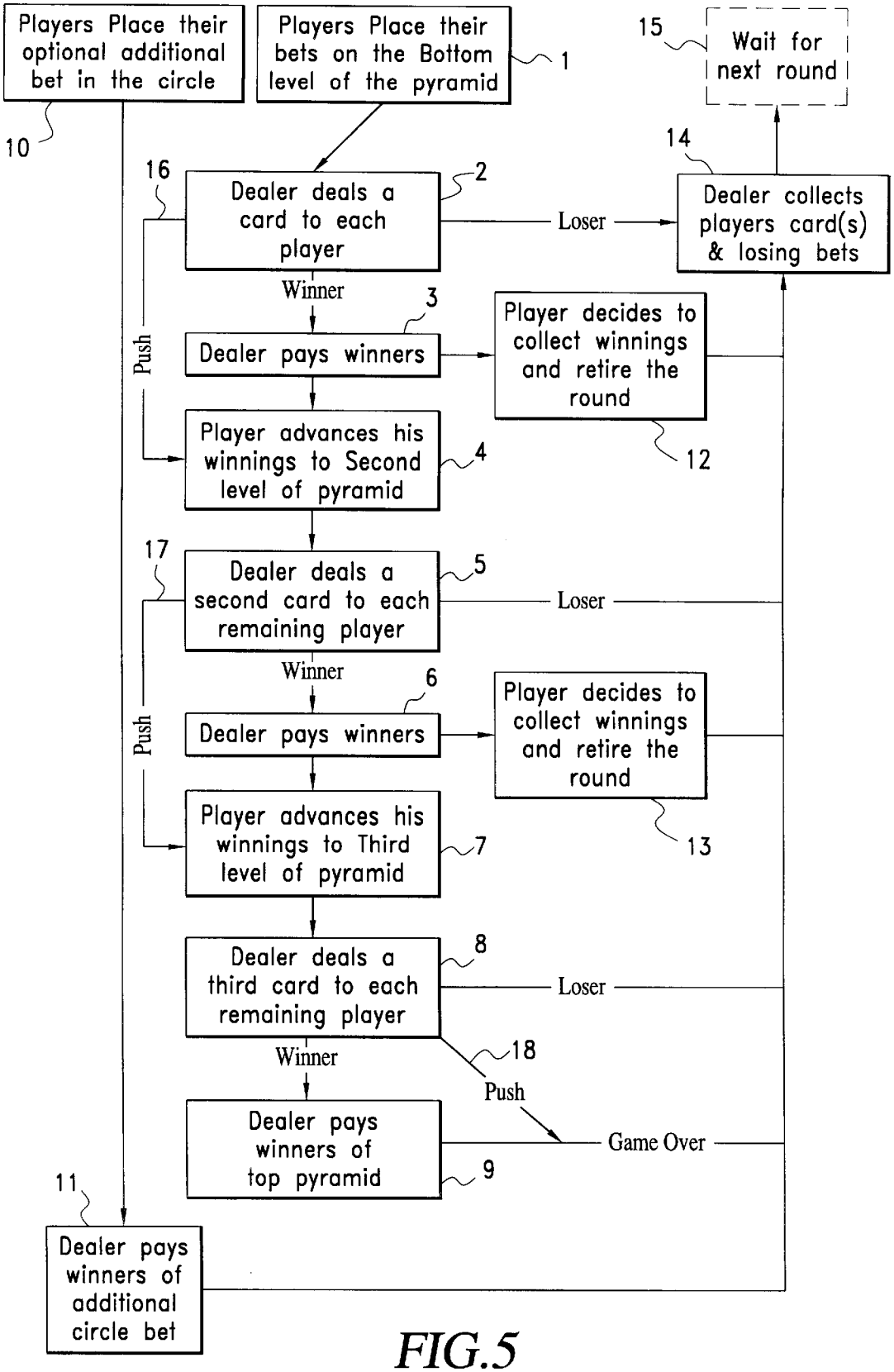
FIG. 5 illustrates the sequence of steps that must be followed in the game in diagrammatic form.

The details of the steps of play can be seen diagrammatically in FIG. 5. Players place their bets in step 1 and decide whether to place an additional bet in step 10. The dealer will deal a card to each player (step 2) yielding winners and losers. Dealer collects losers cards and bets in step 14 and player waits for next round in step 15. In step 3, winners get paid and in step 4 advance to the next round or collect winnings (step 12). Players that match the dealer's card get a bye or push as indicated in step 16. This sequence is repeated for the second to third round winners and losers (steps 5, 6, 7, 13, and 17). The third level round differs only that the only that the end result of winning is Game Over (steps 8, 9 and 18). Note that the provision in step 10 allows for an optional bet, which is paid off in step 11 provided that the conditions of the payoff are met.

A wager is made before the beginning of play in the first round. This wager will be typically in increments of $5 and $10 depending on casino minimums and rules. Progressing up the pyramid allows the player to get successively bigger payouts.

As described herein the display is a three-tiered pyramid. In the preferred embodiment each game consists of three rounds, each round is played on one tier starting at the bottom of the pyramid and progressing to the next tier. A dealer is used to dispense the cards to the players. One card is dealt to each player in each round and to the dealer in the first round. Players may advance to the next round only by winning the previous round. Upon winning the round the player receives a payoff based on the statistical odds of winning. The payoffs in each succeeding round increase while the odds of winning shrink.

A single deck is shuffled prior to the start of the game. The player makes a wager on the bottom tier of the pyramid. Player wins if either a Jack (J), Queen (Q), King (K), or Ace (A) is dealt. In one preferred embodiment, the payoff is two to one. A losing player forfeits the wager and the card is removed from the board. The player must wait for a new game before placing a new bet.

Round 1 winners have two choices:

The player or players may elect to collect the wager plus the payoff and this finishes the game. He or she must then wait for the next game before placing a new bet on the first tier.

The player may elect to advance to the second round by moving the entire round 1 sum (wager and payoff) to the next level. The entire sum becomes the round 2 wager amount. The player cannot advance a portion of the winnings while taking some profits off the board.

Throughout the game, winning cards (i.e. matching the dealt cards with the symbols on the display) earn the player the right to advance to the next round. Winning cards provide both a payoff and the right to advance. In one preferred embodiment, an exception is made in the first round. If a player's card matches the dealer's card the player may advance to the next round without receiving any payoff. For example, if the player is dealt a card with a numeric value of 4 and the dealer's card has a numeric value of 4 then a match occurs. The 4 does not match the symbols for display on the game board. This method of advancing without a payoff is called a bye option. The initial round 1 wager may simply advance to the next tier in the pyramid serving as the wager for the second round. No reshuffling of the cards takes place in between rounds up the pyramid.

In the second round the winners are players who received a Queen, King or an Ace. In a preferred embodiment, the payoff in the second round is three to one. The payoff is based on the entire round 2 wager amount. A winning hand earns the right to advance to the third round by moving the entire sum (wager and payoff) to the top tier on the pyramid. No bye option is available in round 2.

In the third and final round the winning cards are King and Ace. In a preferred embodiment, the payoff in round 3 is five to one.

An additional winning opportunity exists for players who receive three consecutive Aces in three rounds. Eligibility is based on an additional wager placed before the beginning of round 1. In one preferred embodiment, the wager is a one dollar bet placed to the right of the pyramid in a marked location W and the payoff for three Aces is fifty to one, which replaces the traditional five to one payoff in round 3.

In an example, player one bets $5 and wins collecting $10 for round 1. The player can then collect the total of $15 and retire from this game or place it as a round 2 wager. If the player wins round 2 he will win $45 and can collect the $60 (includes $15 from round 1) and retire from this game or place it as a round 3 wager. If the player wins round 3 he will win $300 and can collect $360 (includes $60 from round 2). If the player draws three Aces in succession in each of the rounds and the one dollar additional wager had been placed before round 1 the payoff in round 3 would be $3000 (50:1) for a total of $3060.

This invention encompasses the concept of a portable game board design sutiable for home use. The board could be foldable to allow for easy transport and storage. All elements of the game would be the same except for the smaller size of the game board. A dealer can be designated among the players of the game. Wagering could be done with in game supplied denominations having no real currency value.

Figure 4:
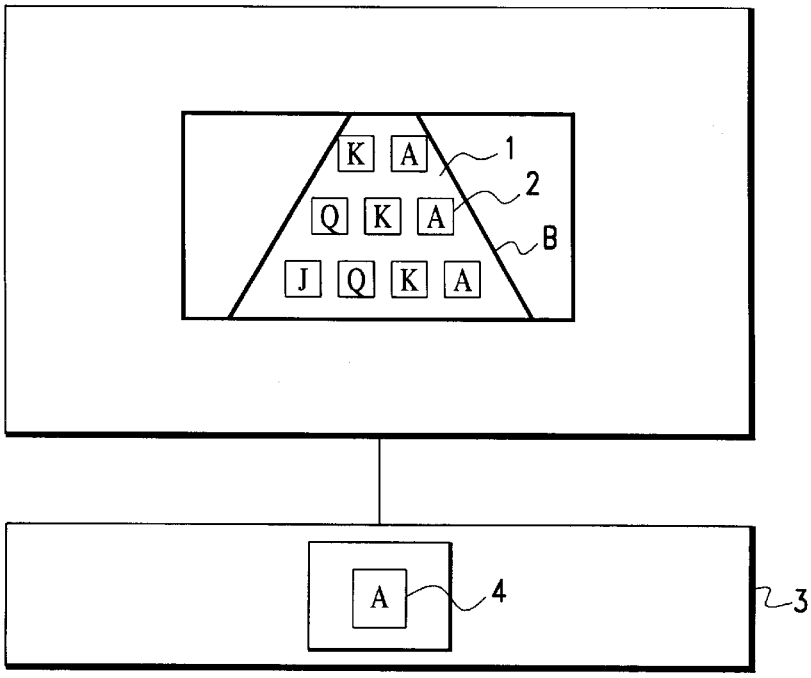

Note that this game may be played by the use of electronic equipment. In this case the card symbols for display on a game board may be presented on a light emitting diode or liquid crystal display as in FIG. 4. In FIG. 4 the pyramidal display 1 may be visualized by either a light emitting diode or a liquid crystal display as contained in one display assembly 2. The random card generating means box is denoted as 3. The cards electronically dealt may be displayed as may be seen in number 4. The cards that are dealt electronically may be displayed for each player who has placed a bet, as well as a dealer. Cards are internally generated by electronic means.

What is claimed is:

1. A method of playing a game of chance comprising the steps of selecting symbols for display on a game board, arranging said selected symbols in an array of at least three groups, providing a source for matching symbols, arranging the source for selection therefrom for matching said symbols in amounts providing statistical odds of a match in a first group of symbols of a highest amount and a match in a second group of symbols of a lower amount, and a match in a third group of symbols of a lowest amount, and selecting in sequence from said source matching symbols to determine in a corresponding sequence a match with said symbols in said first, second and third groups, wherein each act of matching symbols in the first, second, and third groups is associated with a round of play, wherein only those individuals playing the game who have successfully matched the symbols in the first group of the first round of play may play in the second group and only those individuals playing the game who have successfully matched the symbols in the second group of the second round of play may play in the third group, whereby a match is associated with progressive odds so as to contribute to the play value of the game of chance;

wherein a wager is placed for a round of match play and each subsequent round of wagering depends on prevailing in the previous round.

2. A method of claim 1, wherein the game board is in the shape of a pyramid.

3. A method of claim 1, wherein the selected symbols for display are imprinted on a game board surface.

4. A method of claim 1, wherein the symbols are card symbols derived from a deck of cards.

5. A method of claim 1, wherein a game board surface is made of cloth.

6. A method of claim 1, wherein a game board surface is made of plastic.

7. A method of claim 1, wherein a game board surface is made of cardboard.

8. A method of claim 1, wherein a first wager is made prior to the start of play for each group and a payoff is made at a fixed predetermined odds level upon successful matching of the display symbols by matching symbols and if play is continued to the next group the payoff from the previous group winnings plus the first wager must be used in its entirety for the starting wager in the succeeding group.

9. A method of claim 8, wherein the payment of a second wager made prior to the start of play will allow for the multiplication of the payoff for those individuals playing the game who have successfully matched the same symbols in the first, second and third group.

10. A method in claim 1, wherein the selected symbols are presented on an light emitting diode display disposed on said game board.

11. A method in claim 1, wherein the selected symbols are presented on a liquid crystal disposed on said game board.

12. A method in claim 1, wherein the source of the matching symbols is a random card generating means.

13. A method as in claim 1, wherein the game board is portable.

* * * * *